US007779998B2

(12) United States Patent
Heiskanen et al.

(10) Patent No.: US 7,779,998 B2
(45) Date of Patent: Aug. 24, 2010

(54) HEAT TREATED PACKAGE FORMED FROM FIBRE BASED PACKAGING MATERIAL

(75) Inventors: Isto Heiskanen, Imatra (FI); Harri Kujala, Imatra (FI); Timo Räisänen, Imatra (FI)

(73) Assignee: Stora Enso Oyj, Helsinki (FI)

( * ) Notice: Subject to any disclaimer, the term of this patent is extended or adjusted under 35 U.S.C. 154(b) by 787 days.

(21) Appl. No.: 10/562,905

(22) PCT Filed: Apr. 27, 2004

(86) PCT No.: PCT/FI2004/000256

§ 371 (c)(1),
(2), (4) Date: Jul. 10, 2006

(87) PCT Pub. No.: WO2005/003460

PCT Pub. Date: Jan. 13, 2005

(65) Prior Publication Data

US 2007/0060986 A1 Mar. 15, 2007

(30) Foreign Application Priority Data

Jul. 1, 2003 (FI) ..... 20030987
Jul. 1, 2003 (FI) ..... 20030988

(51) Int. Cl.
*B65D 69/00* (2006.01)
*D04H 1/00* (2006.01)
*B65B 55/02* (2006.01)

(52) U.S. Cl. ..... 206/223; 428/292.1; 53/425

(58) Field of Classification Search ..... None
See application file for complete search history.

(56) References Cited

U.S. PATENT DOCUMENTS

| | | | | |
|---|---|---|---|---|
| 4,431,826 | A | 2/1984 | Sweeney | |
| 5,492,741 | A * | 2/1996 | Akao et al. | 428/35.2 |
| 5,626,719 | A | 5/1997 | Tansley et al. | |
| 6,489,040 | B1 * | 12/2002 | Rohlf et al. | 428/532 |
| 7,628,885 | B2 * | 12/2009 | Hübinette et al. | 162/123 |
| 2003/0059591 | A1 * | 3/2003 | Penttinen et al. | 428/212 |
| 2006/0280941 | A1 * | 12/2006 | Penttinen et al. | 428/375 |

FOREIGN PATENT DOCUMENTS

| | | | |
|---|---|---|---|
| EP | 0275851 | A1 | 7/1988 |
| EP | 0292975 | A1 | 11/1988 |
| EP | 1091043 | A1 | 4/2001 |
| FI | 84197 | C | 6/1990 |
| FI | 112048 | B | 10/2001 |
| GB | 1126260 | | 9/1968 |
| JP | 2000-6294 | A | 1/2000 |
| JP | 2000-107268 | A | 4/2000 |
| JP | 2003-027390 | A | 1/2003 |
| JP | 2003-27390 | A | 1/2003 |
| WO | WO-01/49938 | A1 | 7/2001 |
| WO | WO-02/090206 | A1 | 11/2002 |
| WO | WO-03/021040 | A1 | 3/2003 |
| WO | WO-03/068505 | A1 | 8/2003 |

* cited by examiner

*Primary Examiner*—D. Lawrence Tarazano
*Assistant Examiner*—Camie S Thompson
(74) *Attorney, Agent, or Firm*—Birch, Stewart, Kolasch & Birch, LLP

(57) ABSTRACT

The invention relates to a package intended for thermal treatment comprising a fiber-based packaging material treated with a hydrophobic size and comprising one or more layers for reduced water penetration outside and/or inside the fiber substrate. The package of the invention is characterized by the fiber substrate being treated with a combination of a wet-strength size, a hydrophobic size and an aluminum and/or calcium compound for increased heat resistance of the packaging material, and in that the ratio of hydrophobic size to the aluminium and/or calcium compound is 1:1-1:10.

26 Claims, No Drawings

HEAT TREATED PACKAGE FORMED FROM FIBRE BASED PACKAGING MATERIAL

STATE OF THE ART

The invention relates to a package intended for treatment by heating, such as autoclaving, in which a fibre-based packaging material coated at least on one side with a layer for reduced water penetration, such as a polymer coating, has been used. The invention also comprises a fibre-based, optionally polymer-coated packaging material for the package and a method for producing the packaging material.

It is previously known to use fibre-based packaging materials in packages to be treated by heating, such as autoclaving. For this purpose, the fibre-based packaging material typically requires coating, with e.g. a polymer coating, in order to prevent wetting of the fibre base under the effect of the product packed in the package and/or external moisture, especially water vapour used in autoclave treatment.

A variety of coating polymers are usable as a moisture or water vapour barrier in a packaging material. In addition, the polymer layers may vary in number and thickness depending e.g. on the polymer used. A commonly used moisture barrier comprises polyolefins, such as low-density polyethene (LDPE) or polypropene (PP), which, when disposed as the outermost coating layer, also serve as efficient heat-sealing polymers. It is also possible to use polyesters, such as polyethylene therephtalate (PET). Oxygen barrier polymers comprise e.g. ethylene vinyl alcohol polymer (EVOH) and polyamide (PA). Aluminium foils have also been commonly used in fibre-based autoclave packages.

A fibre-based autoclave package, such as a container, casing or box made from packaging board, involves the problem of liquid or moisture penetrating during autoclave treatment through the raw edges of the package. There have been efforts to solve this problem of "raw edge-penetration" or "edge-soaking" i.a. by protecting the raw edges of the material by chemical or mechanical means, e.g. by bending. Chemical protection has been performed by impregnating the raw edges with a hydrophobic size.

WO 02/090206, for instance, describes a method aiming at reduction of water penetration into the packaging material by providing a completely hydrophobic fibre-based board by means of a water suspension or emulsion of a size consisting of alkyl ketene dimer (AKD). WO 03/021040 uses, besides hydrophobic size treatment, a fibre substrate having a specific density (700-850 kg/m$^3$). Both the references use AKD at a rate of about 2-4 kg/t of dry fibre substrate in order to attain a material that withstands autoclave conditions.

GB 2 126 260 describes an alkenyl succinic acid composition, which is the reaction product of olefin compositions and succinic acid, and is intended for use as a hydrophobic size in paper production. In this reference, a cationic substance can be added to the paper to be produced in addition to this size for enhanced size retention. The reference mentions as cationic substances alum, cationic starch, aluminium chloride, long-chained fatty acids, sodium aluminate, substituted polyacrylic amide, chromium sulphate, animal size, cationic thermo-settable resins and polyamide polymers.

There is further a demand for optional packaging materials usable in packages for thermal treatments, such as autoclaving. There is also a demand for fibre-based packaging materials with good resistance to thermal treatment.

OBJECT OF THE INVENTION

The object of the present invention is to provide a fibre-based packaging material that has unexpected aptness for thermal treatment and especially for thermal treatment while subjected to pressure and possibly vapour, such as autoclaving, and also a method for producing such a packaging material.

The invention has the further object of providing a fibre-based material that is treated with a hydrophobic size and is suitable for heat-treated packages, in which the hydrophobic sizing has excellent resistance to heat treatment, such as autoclave conditions.

The present invention has the further purpose of providing a package made of a fibre-based packaging material and resisting heat treatment, e.g. an autoclave package, which has improved heat resistance.

The invention has the further object of providing a new application of a combination of an alum and/or calcium compound, a hydrophobic size and a wet-strength size, allowing unexpected improvement of the properties of a fibre-based packaging material or packages formed from it, such as their heat resistance, thus providing new improved options for fibre-based heat-treated autoclave packaging materials.

DETAILED DESCRIPTION OF THE INVENTION

As for the characteristic features of the fibre-based packaging material and package of the invention, which is apt for thermal treatment and coated with a layer, such as a polymer layer for reduced water penetration, we refer to the accompanying claims.

It has now been found that the heat resistance of a fibre-based packaging material, i.e. water or vapour absorption/penetration through the raw edge of a fibre-based packaging material (referred to as reduced raw-edge penetration below) can be markedly reduced by treating the fibre substrate with a combination of an alum and/or calcium compound, a hydrophobic size and a wet-strength size. The combination has a weight ratio of hydrophobic size to alum and/or calcium compound of 1:0.1-1:10.

The combination of the invention has a surprising synergistic effect on the heat resistance of a fibre-base packaging material. The use of this combination is effective e.g. in the prevention of raw-edge penetration during heat treatment of e.g. a heat-sterilised packaging material. In addition to allowing reduction of raw edge penetration under the prevailing atmospheric pressure, i.e. not subjected to pressure, in a thermally treated material such as a conventionally hydrogen peroxide-sterilised material, the combination surprisingly markedly reduces raw-edge penetration also in materials that have been subjected to heat treatment under pressure, especially under pressure and vapour, such as materials subjected to autoclave treatment. The combination further allows for reduction of the proportion of e.g. hydrophobic size in a fibre-based autoclave packaging material without impairing the hydrophobic and raw-edge penetration reducing properties of the material, which is beneficial also in terms of the other properties of the packaging material.

Also unexpectedly, the combination has a variable effect depending on the heat-treatment method. It was found that a change of the component proportions, for instance, can further enhance the reducing effect of the combination on raw-edge penetration, especially in a fibre-based packaging material treated in an autoclave under rough conditions, although the same change does not produce the same effect in materials that have been subjected to heat treatment under normal pressure, such as a hydrogen peroxide treatment.

Consequently, the invention proposes the use of a combination of an alum and/or calcium compound, a hydrophobic size and a wet-strength size in order to reduce the heat resistance, e.g. the raw-edge penetration of fibre-based packaging materials intended for packages subjected to thermal treatment.

The effect of the components in the combination is explained in further detail below.

The tests conducted in connection with the invention showed that the heat resistance of a fibre-based package was markedly improved when the fibre substrate, in addition to treatment with hydrophobic size, comprised additions of 0.1-10, such as 1:1-1:10 of an alum and/or calcium compound per weight part of hydrophobic size. The improving effect on the heat resistance of these compounds was surprising, considering that they have usually been used in the paper and board industry to increase the retention of a hydrophobic size to a fibre substrate, for instance.

It was further found that the combined treatment of the invention, which was performed with a hydrophobic size and an alum and/or calcium compound, markedly reduced water or vapour absorption/penetration through the raw edge of a fibre-based packaging material. This reduction of raw-edge penetration was particularly advantageous in thermally treated packages compared to packages that had not been thermally treated. Thus the present invention is perfectly suitable for packages intended for heat treatment, such as autoclave packages.

Now it has also been found that addition of a wet-strength size to a fibre substrate treated in accordance with the invention surprisingly leads to further reduction of raw-edge penetration in the package. The reducing effect of a wet-strength size in combination with a hydrophobic size is also unexpected, considering that this size usually has a different purpose of use in the art. It is used in packaging materials that are not basically subject to moisture protective efforts, being intended to increase the strength of moist paper or board as the package gets wet. This is why it is called "wet strength improving agent". An autoclave packaging material is a special application specifically intended to prevent the access of moisture to the fibre substrate, so that wet-strength sizes have not usually been used in such autoclave packaging materials.

Thus the three-component combination of the invention unexpectedly yields a synergistic effect in a material subjected to heat treatment, especially pressurised heat treatment, and this effect cannot be explained merely with the wet-strength increasing properties. Without commitment to any theory, the increasing effect of an alum and/or calcium compound used in accordance with the invention on the heat resistance of i.a. hydrophobic sizing is probably due to the fact that this compound deactivates any acid-form compounds present as impurities in the size.

The invention also provides a fibre-based packaging material coated at least on one side with a water penetration reducing layer for packages intended for thermal treatment, the packaging material comprising the three component-combination of the invention for improved heat resistance, e.g. for reduced raw edge penetration in a heat-treated package made from this material. The packaging material is preferably intended for autoclave packages.

The invention further provides a package that is intended for heat treatment and has been made of the packaging material of the invention. The package is preferably an autoclave package.

The terms used in the context of the present application have the following meanings:

A "fibre substrate" denotes packaging paper or board made especially of bleached pulp, which is produced in a manner well known in the papermaking industry.

"Treatment by heating" or "thermal treatment" means the treatment of a package, e.g. an empty package or a package containing a product (such as a foodstuff) at raised temperature, e.g. above 70° C., such as 80-100° C., or at an even higher temperature, e.g. 100-250° C., depending on the treatment. The treatment period may vary e.g. in the range from 5 min to 30 h, depending i.a. on the treatment mode adopted and the temperature. Thermal treatment can further be performed under normal pressure (in other words, the system is not subjected to pressure). As an example of this, we may cite the conventional aseptic treatment or sterilising treatment e.g. in a heating bath or with spraying of a treatment liquid, such as a conventional hot hydrogen peroxide treatment or treatment with hot water, e.g. post-pasteurisation in a water bath at 95° C. for 10 minutes or at 70° C. for 1700 minutes. Optionally, thermal treatment can be performed under pressure, e.g. in a closed system under the pressure generated during heating, such as heat treatment under saturated vapour pressure. The term "thermal treatment" thus comprises "autoclave treatment", meaning in this context treatment of the package at a raised temperature, e.g. 100-200° C., usually 120-130° C., with the aid of vapour, such as water vapour, usually under pressurised conditions, typically under saturated vapour pressure. The treatment is usually implemented for sterilising a packaged product, i.e. for destroying and preventing harmful microbial growth. Autoclaving is well known e.g. in the foodstuff and pharmaceutical industries. We may cite as an example of treatment conditions treatment in a closed space at about 125° C. over a period of 20 minutes, 45 minutes or 60 minutes. Autoclave equipment is commercially available and autoclave treatment conditions for sterilising a packaged product are commonly known. Autoclave treatment under "rough conditions" in this context implies autoclave treatment performed at 120-130° C., e.g. 125° C., and under saturated vapour pressure, e.g. water vapour pressure, for 45-70, e.g. 50-65 minutes, such as 60 minutes.

Hence "thermal treatment" also covers various heat sterilising methods adopted within industries.

"A packaging material intended for packages to be thermally treated" is apt for use in the forming/production of a package of the invention intended for thermal treatment, such as an autoclave package in a manner known per se. The packaging material is preferably used for producing an autoclave package.

"A package intended for thermal treatment" and "an autoclave package" imply a package in which the packaging material consists of a fibre substrate material coated with a water penetration reducing layer, such as a polymer coating, and whose properties are suitable for the above heat treatment, such as autoclave treatment, in other words, it ha been given water-repellent and heat resisting properties by means of hydrophobic size and coating layers, such as polymer coatings.

"An autoclave package" means generally a package apt for heat treatment under pressure, e.g. suitable for autoclave treatment. The term "package for thermal treatment" or "autoclave package" naturally covers packages that will be subsequently subjected to heat treatment or that haven already been subjected to such treatment. In addition, the package that has been or will be subjected to thermal treatment may be empty or it may contain the product for which it is intended.

"An aluminium and/or calcium compound" may be a compound known in connection with the production of paper or board, which is used in prior art i.a. for increased retention of a hydrophobic size to a fibre substrate. This compound may be e.g. a salt, such as alum, which is a particularly advantageous compound for the purpose of use of the invention. Alum is available as a commercial product. Also polyaluminium chloride (PAC), which is commercially available, can be used for this purpose.

"A hydrophobic size" implies any adhesive, by means of which a fibrous substrate is made water-repellent, i.e. hydrophobic. This group of sizes is commonly known in the art under the name "sizing agents", for instance. In one application, the hydrophobic size covers the hydrophobic sizes that are suitable in the art or conventional, yet with the exception of rosin sizes, i.e. it covers all other sizes except these rosin sizes.

We may cite as an example of a useful hydrophobic size a size consisting of the reaction product of a mixture of succinic acid anhydride and hydrocarbyl or hydrocarbyls, e.g. of an olefin or olefin composition comprising more than 13 carbon atoms. In this context, this size will be referred to with the name known in the art, ASA size, which preferably is a reaction product of a mixture between succinic acid anhydride and straight-chained or branched olefins comprising 13-25 carbon atoms. The olefin portion may consist of a mixture of straight-chained or branched $C_{13}$-$C_{25}$-alkenes. ASA is preferably a size consisting of a so-called alkenyl succinic anhydride, e.g. $C_{13}$-$C_{22}$-alkenyl succinic acid anhydride, such as a commercial ASA product.

We may further cite as a useful hydrophobic size a size consisting of a so-called alkyl ketene dimer (AKD), which is well known in the art. In this context, it means a hydrocarbyl ketene dimer product, which has been formed e.g. from an unsaturated or saturated, straight-chained or branched fatty acid and a mixture of such fatty acids, e.g. $C_{16}$ or longer chained fatty acids or mixtures of these, e.g. $C_{16-30}$, appropriately $C_{16-22}$, such as $C_{16}$, $C_{18}$, $C_{20}$ or $C_{22}$, preferably $C_{16}$ or $C_{18}$ fatty acids or a mixture of these. In this context, these products are referred to as "alkyl ketene dimer" (AKD) under the practice in the art. An advantageous AKD size is a commercially available product, in which the hydrocarbon chain of the ketene dimer has been formed of a mixture of $C_{16}$ and $C_{18}$ fatty acids ($C_{16}$/$C_{18}$ AKD).

Hence, both an ASA and an AKD size may consist of commercially available products, which may be in the form of a water suspension or emulsion, and may also contain other additives.

Compared to prior art, the hydrophobic size of the present invention can be used in smaller amounts in order to attain good heat resistance, such as autoclave resistance, achieving advantages in processes for producing and converting board (or paper). Thus, for instance, reduced dosage of hydrophobic size results in improved adhesion of i.a. plastic coatings to the treated fibre substrate, and this, in turn, has a beneficial impact on the autoclave resistance of the package, for instance.

A "wet-strength size" implies a size group well known in the art, which consequently is mostly used for increasing/improving the strength of a wet paper or board ("wet strength improving agent"). Among such sizes, we may cite i.a. polyamide epichlorine hydrine resin (PAAE), urea formaldehyde resin (UF), melamine formaldehyde resin (MF), polyacrylic amide/glyoxal condensate, polyvinyl amine, polyurethane, polyisocyanate. Preferred sizes include e.g. PAAE and isocyanate, especially the PAAE size.

The combination components of the packaging material of the invention may be used in the following amounts.

The weight ratio of hydrophobic size to the aluminium and/or calcium compound is e.g. 1:0.1-1:10, preferably 1:0.1-1:7, such as 1:0.5-1:7, more advantageously 1:0.5-1:5. In a second embodiment, the weight ratio of hydrophobic size to the aluminium and/or calcium compounds is 1:1-1:10, preferably 1:1-1:7, such as 1:1-1:5, and still more advantageously 1:1-1:3. In a preferred embodiment, this compound is a salt, preferably alum, which is used in the ratio mentioned above. We may cite as a specific example the size: (Al and/or Ca compound) ratio, preferably size:alum ratio of 1:2.

The amount of aluminium and/or calcium compound may be e.g. 0.1-20 kg/t of dry fibre substrate, preferably 1.0-10 kg/t of dry fibre substrate, e.g. 2.0-8 kg/t of dry fibre substrate.

The amount of hydrophobic size added to the fibre substrate may be 0.3-4 kg/t of dry fibre substrate, preferably 0.5-3.0 kg/t of dry fibre substrate. In some applications, it is also possible to use 0.5-1.7 kg/t of dry fibre substrate. The hydrophobic size is preferably an ASA size.

Wet-strength size can be added to the fibre substrate at a rate of 0.2-12 kg/t of dry fibre substrate, preferably 0.5-6 kg/t of dry fibre substrate, more advantageously 1-3 kg/t of dry fibre substrate. In a second embodiment, wet-strength size can be added at a rate of 0.2-12 kg/t of dry fibre substrate, preferably 1-6 kg/t of dry fibre substrate, and more advantageously 2-4 kg/t of dry fibre substrate. The wet-strength size is preferably a PAAE size.

The packaging material of the invention for e.g. autoclave application may contain wet-strength size in preferably a ratio of 0.1-5 weight parts, e.g. 0.5-3 weight parts, preferably 1-2.5 weight parts, such as a specific example 2 weight parts per one weight part of hydrophobic size. A preferred combination combines PAAE size and ASA size, and it is used in the weight ratios above, with the example PAAE:ASA 1:1.

Owing to the combination of the invention, autoclave packages, for instance, may comprise a fibre substrate with lower density, thus increasing the variability of the mechanical properties of the package within the range of autoclave applications.

We set forth as one preferred embodiment of the invention packages intended for thermal treatment under pressure, especially autoclave treatment, in which the fibre-based packaging material of the invention has been used.

In accordance with the invention, the fibre-based packaging material has been coated on one or both sides with at least one coating layer for reduced water penetration. The coating may be any coating known in the art for reduced water penetration, such as a polymer coating or a varnish, such as a polymer coating.

In a further preferred embodiment of the invention, there are one or more, possibly pigmented polymer layers as known in the art outside or inside the fibre substrate of the package intended for thermal treatment, e.g. autoclave treatment. In one embodiment, the packaging material comprises in the following order: a polymer heat-sealing layer, a white-pigmented polymer layer, a polymer layer containing black pigment, a treated fibre substrate, one or more polymer oxygen barrier layers, a binder layer, a grey-pigmented polymer light-shield layer and a polymer heat-sealing layer.

The material of the polymer layers may comprise any materials commonly known in the art. Thus, for instance, the material of the heat-sealing layer is preferably polypropene (PP), polyethene (PE) or a copolymer of these. The material of the oxygen-barrier layer is preferably ethylene vinyl alcohol polymer (EVOH) or polyamide (PA), most advantageously EVOH.

Owing to the improved heat resistance, such as autoclave resistance, the proportion of coatings, such as polymer coatings in the packaging material of the invention can be reduced if desired.

The heat resistance, e.g. autoclave resistance of the treated fibre substrate may be further improved by adjusting and/or optimising its structure during the production. Autoclave resistance can thus be increased by means of the refining degree of the raw material, such as high-consistency refining; calendering/wet pressing of the fibre substrate web; and/or drying of the web, such as Condebelt drying. A filler, such as titanium dioxide, can be added to the treated fibre substrate in order to provide a fibre substrate that withstands well hot conditions, such as e.g. autoclave conditions.

The treatment of a fibre substrate in accordance with the invention typically means that the fibre-based packaging material has been completely treated, i.e. over the entire width if the web, with a combination of wet-strength size, a hydrophobic size and an aluminium and/or a calcium compound as claimed in the invention. However, the invention also comprises the option of performing a treatment of only a portion of the material, such as say, the cut edges.

The invention further relates to a method for preparing the packaging material of the invention, the method comprising addition to the fibre substrate of a hydrophobic size and an aluminium and/or calcium compound in the ratio 1:0.1-1:10 and also of a wet-strength size for increased heat resistance of the package to be produced and/or for reduced raw edge penetration. The treatment can be performed in any order using methods known in the art.

The hydrophobic size and the aluminium and/or calcium compound, such as alum, are preferably added in the amounts indicated above. The addition may be performed e.g. in a manner known from paper and board production at any stage of the production process before the last drying step of the fibre substrate web, however, preferably during the production of the fibre substrate stock, i.e. before the fibre stock is brought onto the wire, so that the combination is homogenously incorporated in all of the fibre substrate web formed on the wire. Optionally, a fibre substrate web can first be formed from the fibre stock on the wire, and then the hydrophobic size and/or aluminium and/or calcium compound is brought onto the fibre substrate web e.g. by spraying onto the web. The hydrophobic size and the aluminium and/or calcium compound can be added in the same or a different step of the process for preparing the fibre substrate. The aluminium and/or calcium compound can thus be added before the hydrophobic size is added, simultaneously with this addition or after the addition of hydrophobic size. The entire amount of hydrophobic size and of aluminium and/or calcium compound to be used can be added in one process step, e.g. during stock formation, but it is also possible to add one or both of the size and the compound in more than one step for preparing the fibre substrate. In one preferred application, one portion of alum is added before the hydrophobic size and the remainder is added after the size addition.

In the example above, wet-strength size is further added to the fibre substrate in the amounts given above, thus achieving further improvement of the resistance of the fibre substrate under autoclave conditions. The addition can be made in a manner known in the art, e.g. in the stock preparation step, before the stock is brought onto the wire.

The use of the wet-strength size in accordance with the invention allows the production of a board resisting even autoclave conditions and having density and porosity properties different from those of a board prepared merely with the aid of hydrophobic size. Thus the invention provides different options of autoclave packaging materials alongside those already in use. It also allows for the use of a board with lower density, i.e. provides higher rigidity.

It is further possible to prevent the formation of impurities in free acid form derived from hydrophobic size, e.g. ASA size, which may have a harmful effect on the heat resistance of the packaging material, during the manufacture of the treated fibre substrate, by controlling the process conditions, i.e. by a short size delay at the wet end of the papermaking machine and by good first-pass retention.

If desired, the heat resistance, such as autoclave resistance of the fibre substrate can be further improved by adjusting the fibre substrate structure, e.g. the refining degree of the raw material (e.g. by high-density refining), by calendering/wet pressing and/or drying of the fibre substrate web (e.g. Condebelt drying). It is further possible to add a filler, such as titanium dioxide, e.g. 0.1-5 w % calculated on the dry fibre substrate, to the treated fibre substrate in order to provide a fibre substrate that has good resistance to hot conditions, such as autoclave conditions.

As described above, the invention relates to the use of the combination of the invention, i.e. a combination of an aluminium and/or calcium compound, a hydrophobic size and a wet-strength size in order to improve the heat resistance, especially autoclave resistance, such as raw edge penetration of a fibre-based packaging material in a fibre-based packaging material subjected to thermal treatment, such as an autoclave packaging material, especially in a packaging material of the invention as defined above. The invention is described in greater detail below by means of examples.

Exemplifying Part

The examples examined the effects of different factors on the raw-edge penetration of board under autoclave conditions.

The autoclave tests were conducted with a water-vapour sterilising autoclave at a temperature of about 125° C. "Normal" autoclaving conditions were performed at about 125° C., for 45 min, 100% RH, and "rough conditions" at about 125° C., for 60 min, 100% RH. RH=relative humidity. The autoclave treatment also included a step of raising the temperature (of about 15 min) and a step of dropping the temperature (of about 20 min).

The samples to be tested during testing were coated on both sides with a polymer coating so that only the raw edge of the board was visible. As raw edge penetration, REP of the autoclave testing, the water amount was measured which penetrated to the board through the edges of the sample. The penetration was indicated per surface area of raw edge (kg/$m^2$) after autoclaving.

Raw edge penetration REP 80° C. means that the samples were dipped under normal pressure into 80° C. water for three hours, and then the measurement was conducted.

Raw edge penetration REP $H_2O_2$ means that the samples were dipped into a 35% hydrogen peroxide solution having a temperature of 70° C. for 10 minutes, followed by the measurement.

SR stands for the drainage resistance of the pulp under the Schopper-Riegler method.

The examples and comparative examples of the invention used 150 g/$m^2$ hoard samples, which had been prepared from dry birch sulphate pulp (refined with a disc refiner to a SR value of 22) in a papermaking machine using chemicals conventionally used in board production. The press section was a conventional 3-nip press section with felts on both sides. The drying section was an ordinary model equipped with steam cylinders. Calendering was performed with a hard-nip calender (15 kN/m). For each comparative test, the board samples to be compared were prepared in the same manner so as to differ only with respect to the composition or differences necessary for the comparison of the production conditions. These differences with respect to the production step and/or composition of the samples are mentioned separately for each comparative example. Any addition of hydrophobic size, Al/Ca compound and wet-strength size was done to the stock before it was brought onto the wire. The ratios are weight ratios.

EXAMPLE 1

Effect of the Use of Alum Under Autoclave Conditions

Solid board was stuff-sized with an ASA size (2.5 kg/t) and a PAAE wet-strength size (2 kg/t).

| | Autoclave conditions | | | |
|---|---|---|---|---|
| ratio ASA size:alum | Rough REP | Normal REP | REP water, 80° C. | REP $H_2O_2$ |
| 1:0 | 9.9 | 8.1 | 2.2 | 1.3 |
| 1:1 | 3.8 | 1.6 | 1.3 | 0.33 |
| 1:2 | 2.4 | 1.6 | 1.4 | 0.33 |

REP = Raw-edge penetration (kg/m$^2$)

The test scores clearly show the markedly reducing effect of alum on raw edge penetration. An increased amount of alum reduced the raw edge penetration occurring in the autoclave under "rough conditions" even after no improvements with respect to raw edge penetration are observed under "normal" autoclave conditions by means of conventional tests (REP 80 C and REP $H_2O_2$).

EXAMPLE 2

Efficiency of ASA vs. AKD Sizing Under Autoclave Conditions

Solid board was stuff-sized with AKD and ASA in equal amounts. The ratio of alum to hydrophobic size was 1:1 in both cases. Wet-strength size:hydrophobic size was 1:1. Raw edge penetration was determined under three sets of test conditions: by dipping the board samples into 80° C. water for three hours and by autoclaving under "normal" and "rough" conditions as described above.

| | REP 3 h, 80° C. | REP $H_2O_2$ |
|---|---|---|
| AKD sizing (2.5 kg/t) | 2.0 | 0.35 |
| ASA sizing (2.5 kg/t) | 1.4 | 0.34 |

REP = Raw edge penetration (kg/m$^2$)

| | Autoclave conditions | |
|---|---|---|
| | normal REP | rough REP |
| AKD sizing (2.5 kg/t) | 2.3 | 6.2 |
| ASA sizing (2.5 kg/t) | 1.8 | 2.3 |

REP = Raw edge penetration after autoclaving (kg/m$^2$)

The amounts absorbed into the board through the edges of the sample (REP, raw edge penetration) were relatively close to each other with samples sized with AKD and ASA under "normal" autoclave conditions. Under "rough" autoclave conditions, there was a more distinct difference in favour of the board treated with ASA size.

Examples 3 and 4. Effect of wet-strength size (PAAE) during sizing with ASA and AKD: In example 3 and 4, the board had been stuff-sized with two different amounts of hydrophobic size. The amount of wet-strength size was constant at all test locations.

EXAMPLE 3

Effect of Wet-Strength Size (PAAE) During ASA Sizing

| Autoclaving conditions Raw edge penetration, (kg/m$^2$) | normal REP | $H_2O_2$REP |
|---|---|---|
| Low ASA sizing level (1 kg/t) | 15.7 | 15.2 |
| Low ASA sizing level (1 kg/t) + wet-strength sizing (2 g/t) | 4.8 | 2.6 |
| Normal ASA sizing level (3 kg/t) | 5.4 | 0.61 |
| Normal ASA sizing level (3 kg/t) + wet-strength sizing (2 kg/t) | 2.7 | 0.63 |

EXAMPLE 4

Effect of Wet-Strength Size (PAAE) During AKD Sizing

| Autoclaving conditions Raw edge penetration, (kg/m$^2$) | normal REP | $H_2O_2$ REP |
|---|---|---|
| Normal AKD sizing level (2 kg/t) | 9.6 | 14.7 |
| Normal AKD sizing level (2 kg/t) + wet-strength sizing (2 kg/t) | 5.0 | 1.4 |
| Strong AKD sizing level (3 kg/t) | 3.5 | 4.0 |
| Strong AKD sizing level (3 kg/t) + wet-strength sizing (2 kg/t) | 2.0 | 0.4 |

The results of examples 3 and 4 also show the beneficial effect of wet-strength size on the autoclave packaging material. In addition, raw edge penetration decreased notably in samples subjected to autoclave treatment on a normal ASA size level when a combination of ASA size and wet-strength size was used.

EXAMPLE 5

Effect of Refining of the Entire Pulp

Solid board samples were prepared by using a pulp refining degree of 25 SR and 30 SR, respectively. In board production, ASA size (2.5 kg/t), alum (2 kg/t) and PAAE resin (2 kg/t) were used.

| | Autoclave conditions | | | |
|---|---|---|---|---|
| | rough | normal | | |
| | Raw edge penetration ($kg/m^2$) | | | |
| | REP | REP | REPwater80 C. | $H_2O_2$ REP |
| Pulp refining degree 25 SR | 3.8 | 1.6 | 1.3 | 0.33 |
| Pulp refining degree 30 SR | 2.0 | 1.6 | 1.4 | 0.33 |

EXAMPLE 6

A Portion of the Pulp Refined to a Further SR Value 80

The example used low-consistency refining for the entire pulp and the further refined portion. Solid board samples were prepared by using pulp in various amounts with a refining degree of 80 SR ("further refined pulp"). The board production comprised ASA size (2.5 kg/t), alum (2 kg/t) and PAAE resin (2 kg/t).

| Autoclave conditions<br>Raw edge penetration ($kg/m^2$) | Normal<br>REP | REPwater80 C. | $H_2O_2$REP |
|---|---|---|---|
| Proportion of further refined pulp 0% | 1.6 | 1.3 | 0.33 |
| Proportion of further refined pulp 5% | 1.7 | 1.6 | 0.35 |
| Proportion of further refined pulp 15% | 1.8 | 1.4 | 0.34 |

EXAMPLE 7

Effect of Calendering

Solid board samples were prepared by compressing samples at the dry section of a board machine using a machine calender under normal and raised nip pressure (15 and 30 kN/m). Compression could be performed also with a web compression method of some other type (e.g. wet pressing, shoe calendering). The board production comprised ASA size (2.5 kg/t), alum (2 kg/t) and PAAE resin (2 kg/t).

| Autoclave conditions<br>Raw-edge penetration ($kg/m^2$) | rough<br>REP | normal<br>REP | REPwater<br>80 C. | REP<br>$H_2O_2$ |
|---|---|---|---|---|
| Calendering under normal nip pressure | 3.8 | 1.6 | 1.3 | 0.33 |
| Calendering under raised nip pressure | 2.8 | 1.7 | 1.3 | 0.39 |

EXAMPLE 8

Effect of Finely Distributed Filler

Board production comprised AKD size (1.5 kg/t) and PAAE resin (1 kg/t).

| | Autoclave conditions | | | |
|---|---|---|---|---|
| | normal | rough | | |
| | Raw edge penetration ($kg/m^2$) | | | |
| | REP | REP | REPwater80 C. | REP $H_2O_2$ |
| TiO2 dosage 0 kg/t | 6.4 | 6.7 | 1.6 | 1.3 |
| TiO2 dosage 2 kg/t | 3.9 | 6.3 | 1.5 | 1.3 |
| TiO2 dosage 4 kg/t | 3.4 | 7.5 | 1.5 | 1.5 |

The solid board samples contained titanium oxide as mineral fines, however, it could be replaced with fines of some other type (e.g. other paper production fillers).

EXAMPLE 9

Comparison Between Autoclave Boards of a Production Machine Equipped with Condebelt Drying and a Machine Equipped with Conventional Cylinder Drying

| Autoclave conditions<br>Raw edge penetration ($kg/m^2$) | normal<br>REP |
|---|---|
| Normal drying section | 1.4–1.6 |
| Condebelt drying section | 1.0–1.2 |

A Condebelt drying section also allows compression of the board structure to make it withstand autoclaving conditions better.

The results of the examples above show that the use of wet-strength size in the production of autoclave board allows for lower requirements on pulp density and/or porosity.

The invention claimed is:

1. An autoclave package containing a product therein and, comprising a fibre-based packaging material treated with a hydrophobic size and comprising on the inside and/or outside of the fibre substrate one or more layers for reduced water penetration, the package having been treated under pressure at a temperature of 100 to 250° C. for a time of 5 min to 30 h in water vapor, wherein the fibre substrate has been treated with a hydrophobic size, an aluminium compound and a wet-strength size for increased heat resistance of the packaging material, the hydrophobic size has been used in an amount of 0.5 to 3.0 kg/t of dry fiber substrate, the weight ratio of hydrophobic size to the aluminium compound is 1:0.5-1:5, and the layer for reduced water penetration of the packaging material comprises a polymer coating.

2. The package as defined in claim 1, wherein the hydrophobic size comprises at least one size selected from the group consisting of alkenyl succinic acid anhydride (ASA) and alkyl ketene dimer (AKD).

3. The package as defined in claim 1, wherein the hydrophobic size comprises an ASA size.

4. The package as defined in claim 1, wherein the aluminium compound has been used in an amount of 1.0-20kg/t of dry fibre substrate.

5. The package as defined in claim 1, wherein the aluminium compound comprises aluminium salt.

6. The package as defined in claim 1, wherein the wet-strength size has been used in an amount of 0.2-12 kg/t of dry fibre substrate.

7. The package as defined in claim 1, wherein the wet-strength size contains polyamido amine epichlorine hydrine resin (PAAE size).

8. The package as defined in claim 1, wherein the packaging material comprises in the following order: a polymer heat-sealing layer, a white-pigmented polymer layer, a polymer layer containing black pigment, a treated fibre substrate, one or more polymer oxygen-barrier layers, a binder layer, a grey-pigmented polymer light-shield layer and a polymer heat-seal layer.

9. The package as defined in claim 1, wherein a filler has been added to the fibre substrate for increased heat resistance of the package.

10. The package as defined in claim 1, wherein the fibre substrate comprises at least one selected from the group consisting of wrapping paper and board.

11. The package as defined in claim 1, wherein said product contained in said package is a foodstuff.

12. A method for autoclave treatment, comprising using a combination of an aluminium compound, a hydrophobic size and a wet-strength size for increased autoclaving heat resistance of a product package made of a fibre-based packaging material, such as reduced raw-edge penetration, in autoclaving under pressure at a temperature of 100 to 250° C. for a time of 5 min to 30 h, wherein the autoclaving is carried out in water vapor.

13. A method for autoclave treatment of a product package comprising a fibre-based packaging material treated with a hydrophobic size and comprising on the inside and/or outside of the fibre substrate one or more layers for reduced water penetration, comprising:

treating a fibre substrate with a hydrophobic size, an aluminium compound and a wet-strength size for reduced raw-edge water penetration of the packaging material, the weight ratio of hydrophobic size to the aluminium compound being 1:0.1-1:10; and autoclaving the package under pressure with the aid of vapour at a temperature of 100 to 250° C. for a time of 5 min to 30 h.

14. The method as defined in claim 13, wherein the weight ratio of hydrophobic size to the aluminium compound is 1:0.5 to 1:5.

15. The method as defined in claim 13, wherein the hydrophobic size is used in an amount of 0.5 to 3.0 kg/t of dry fibre substrate.

16. The method as defined in claim 13, wherein the hydrophobic size comprises at least one size selected from the group consisting of alkenyl succinic acid anhydride (ASA) and alkyl ketene dimer (AKD).

17. The method as defined in claim 16, wherein the hydrophobic size comprises an ASA size.

18. The method as defined in claim 13, wherein the aluminium compound comprises aluminium salt.

19. The method as defined in claim 18, wherein the aluminium compound is alum.

20. The method as defined in claim 13, wherein the wet-strength size contains polyamido amine epichlorine hydrine resin (PAAE size).

21. The method as defined in claim 13, wherein the one or more layers for reduced water penetration comprise a polymer coating.

22. The method as defined in claim 13, wherein the fibre substrate comprises at least one selected from the group consisting of wrapping paper and board.

23. The method as defined in claim 13, wherein the product package further comprises foodstuff therein.

24. The method as defined in claim 13, wherein said autoclaving is performed on said package when said package is in an empty state.

25. The method as defined in claim 13, wherein said autoclaving is performed on said package when said package has a product contained.

26. An autoclave package containing a product therein and, comprising a fibre-based packaging material treated with a hydrophobic size and comprising on the inside and/or outside of the fibre substrate one or more layers for reduced water penetration, the package having been treated under pressure at a temperature of 100 to 250° C. for a time of 5 min to 30 h in water vapor, wherein the fibre substrate has been treated with a hydrophobic size, an aluminium compound and a wet-strength size for increased heat resistance of the packaging material, the hydrophobic size has been used in an amount of 0.5 to 3.0 kg/t of dry fiber substrate, the weight ratio of hydrophobic size to the aluminium compound is 1:0.5-1:5, and the packaging material comprises in the following order: a polymer heat-sealing layer, a white-pigmented polymer layer, a polymer layer containing black pigment, a treated fibre substrate, one or more polymer oxygen-barrier layers, a binder layer, a grey-pigmented polymer light-shield layer and a polymer heat-seal layer.

* * * * *